United States Patent [19]

Davis et al.

[11] Patent Number: 4,636,115

[45] Date of Patent: Jan. 13, 1987

[54] EXPANSION BOLT AND MINE ROOF REINFORCEMENT THEREWITH

[75] Inventors: Robert L. Davis; Harold D. Keith, both of Rolla, Mo.

[73] Assignee: The Curators of The University of Missouri, Columbia, Mo.

[21] Appl. No.: 205,601

[22] Filed: Nov. 10, 1980

[51] Int. Cl.[4] ..... E21D 21/00

[52] U.S. Cl. ..... 405/259; 405/288; 411/19

[58] Field of Search ..... 411/19, 20, 15, 44, 411/61; 405/259, 260, 288; 403/15, 31

[56] References Cited

U.S. PATENT DOCUMENTS

| | | | |
|---|---|---|---|
| 1,802,270 | 4/1931 | Rawlings | 411/61 |
| 2,667,037 | 1/1954 | Thomas et al. | 411/15 X |
| 3,568,450 | 3/1971 | Whiting | 411/19 X |
| 3,665,719 | 5/1972 | Whiting | 61/45 |
| 3,837,258 | 9/1974 | Williams | 411/44 |
| 3,922,867 | 12/1975 | Scott | 61/45 B |
| 3,940,941 | 3/1976 | Libert et al. | 61/45 B |
| 4,012,913 | 3/1977 | Scott | 61/45 B |
| 4,459,067 | 7/1984 | Skogberg et al. | 405/259 |

FOREIGN PATENT DOCUMENTS

| | | | |
|---|---|---|---|
| 0000576 | 7/1978 | European Pat. Off. . | |
| 80850025 | 3/1980 | European Pat. Off. . | |
| 2199090 | 9/1973 | France . | |
| 2316528 | 7/1976 | France . | |
| 1448753 | 9/1976 | United Kingdom | 411/19 |
| 2072784 | 9/1987 | United Kingdom | 411/19 |

*Primary Examiner*—David H. Corbin

*Attorney, Agent, or Firm*—Senniger, Powers, Leavitt and Roedel

[57] ABSTRACT

An expansion bolt, adapted to be anchored in a hole, having a hollow shank portion adapted to hold a pressurizing fluid and to expand girthwise on pressurization of the fluid, and further having a threaded portion adapted on insertion of the shank portion in the hole to extend out of the hole and to have a nut threaded thereon, whereby, following insertion of the shank portion of the bolt, in an unexpanded condition, in the hole, the shank portion may be expanded by pressurization of fluid therein for anchoring it in the hole and the nut threaded up on the threaded portion of the bolt.

11 Claims, 4 Drawing Figures

EXPANSION BOLT AND MINE ROOF REINFORCEMENT THEREWITH

BACKGROUND OF THE INVENTION

This invention relates to an expansion bolt, and more particularly to an expansion roof bolt adapted to hold a pressurizing fluid therein and to expand girthwise upon pressurization of the fluid for anchorage of the bolt in a bore in the roof of a mine for supporting the roof.

Various types of anchoring means have been used for supporting the roof of a mine. A widely used anchoring means is the "point-anchored" expansion bolt system comprising a bolt having a head and a threaded shank, and an expansible shell unit on the shank at its end away from the head comprising a shell having a plurality of leaves and a tapered plug threaded on the shank. To anchor the bolt in a bore in the roof of a mine, the bolt with the expansible shell unit thereon is inserted in the bore and the bolt is turned, thereby moving the tapered plug down along the shank into engagement with the leaves of the shell held on the shank against movement therealong for forcing the leaves to move outwardly into engagement with the roof strata. Continued turning of the bolt moves the head up into pressurized engagement with the roof, and tensions the shank for clamping the roof strata together. Among the disadvantages of this system is that it is not effective in relatively soft roof strata, such as that found in uranium mines, and that, over time, the expansible shell unit creeps down in the bore with a resultant decrease in the clamping force applied to the roof strata by the bolt.

Another widely used anchoring means is the so-called "grouted" roof bolt system, such as shown, for example, in U.S. Pat. No. 3,940,941, involving two-component charges of epoxy resin and a bolt having a nut threaded on an end thereof. To install the bolt in a bore in the roof of a mine, charges of unmixed resin are inserted in the bore, the bolt is partially inserted in the bore and rotated to mix the components of the resin, and the bolt is fully inserted in the bore with the nut held in engagement with the roof until the resin sets. On hardening of the resin, the bolt is bonded in place, and pegs the roof strata together. However, "grouted" bolts are more difficult and more expensive to install than "point-anchored" expansion bolts, and provide insufficient load carrying capacity in roof strata having significant fractures and voids in that the resin extrudes into these openings with a resultant decrease in the strength of the bond between the bolt and the roof. Moreover, there is no inspection technique, in general use, to evaluate the integrity of the bond.

Yet another and more recently developed anchoring means is the "friction rock stabilizer" system, such as shown, for example, in U.S. Pat. Nos. 3,922,867 and 4,012,913, involving a hollow cylindrical body of steel open at its ends and split along a line parallel to its longitudinal axis to enable the body to contract girthwise upon being compressed for enabling its insertion in a bore in the roof of a mine of smaller diameter than the diameter of the tube when uncompressed. As the tube is inserted, the compressive force is released and the tube expands girthwise into pressurized frictional engagement with the surfaces of the roof defining the bore. While the body is effective in stabilizing relatively soft roof strata and in retaining its load carrying capacity upon shifting of the mine roof, its load carrying capacity is relatively limited, being essentially equal to the upward force applied to the lower end of the body to insert it in the bore.

SUMMARY OF THE INVENTION

Among the several objects of this invention may be noted the provision of an expansion bolt for anchorage in a hole such as a bore in the roof of a mine; the provision of such a bolt which is adapted to hold a pressurizing fluid and to be expanded girthwise upon pressurization of the fluid; the provision of such a bolt which clamps or compresses the roof strata together; the provision of such a bolt which pegs the roof strata together for substantially the entire portion of the length of the bolt in the bore; the provision of such a bolt which is expanded after being fully inserted in the bore; the provision of such a bolt which is effective in stabilizing relatively soft roof strata; the provision of such a bolt which has increased load carrying capacity for supporting the roof; the provision of such a bolt which applies lateral compressive force to the mine roof counteracting, at least in part, the lateral tension force present in a mine roof due to its tendency to sag; the provision of such a bolt which deforms, upon shifting of the mine roof, to retain its load carrying capacity; the provision of such a bolt having a pressure relief feature to prevent "overloading" of the bolt; the provision of such a bolt which may be readily inspected, after its installation, to establish that it remains in pressurized engagement with the surfaces of the mine defining the bore and thus is capable of supporting the roof; the provision of such a bolt which may be expanded further after its installation to increase its load carrying capacity; and the provision of such a bolt which is simple and economical to manufacture and install.

In general, an expansion bolt of this invention is adapted for insertion in an initial unexpanded condition in a hole drilled in a body (e.g., a mine roof) in which the bolt is to be anchored, and adapted to be expanded girthwise after being inserted in the hole to anchor it in the hole. It has an elongate hollow shank portion constituted by a relatively thin-walled tubular metal member closed at one end constituting its inner end as inserted in the hole and having a head at its other end constituting its outer end. The head is exteriorly threaded for reception of a nut and extends out of the hole when the bolt is anchored in the hole. The tubular member, in its unexpanded condition, is of fluted cross section, and is adapted to hold a fluid under pressure and to expand girthwise under pressure of fluid therein. The head is constructed for delivery of fluid under pressure into the tubular member whereby, following insertion of the tubular member in a hole, fluid under pressure may be delivered into the tubular member to cause it to expand girthwise into pressure engagement with the body within the hole for anchoring it in the hole.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
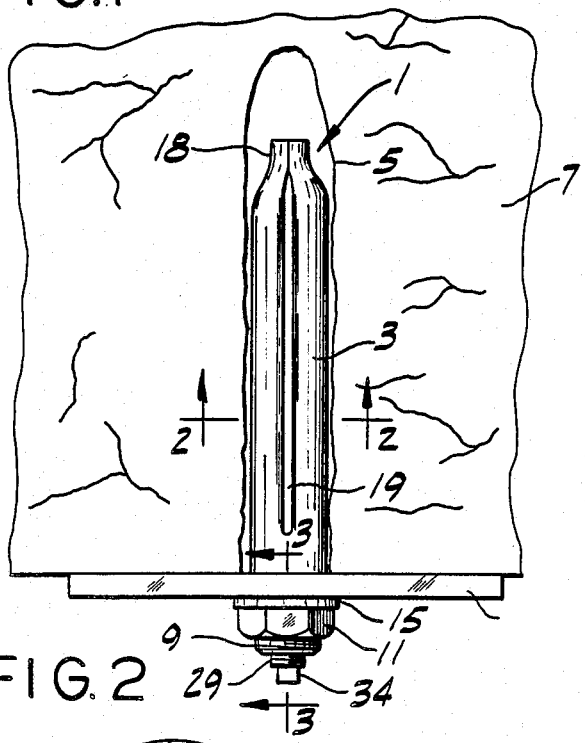
FIG. 1 is a section through a bore in the roof of a mine showing an expansion bolt of this invention therein, prior to the girthwise expansion of the bolt.
Figure 3:
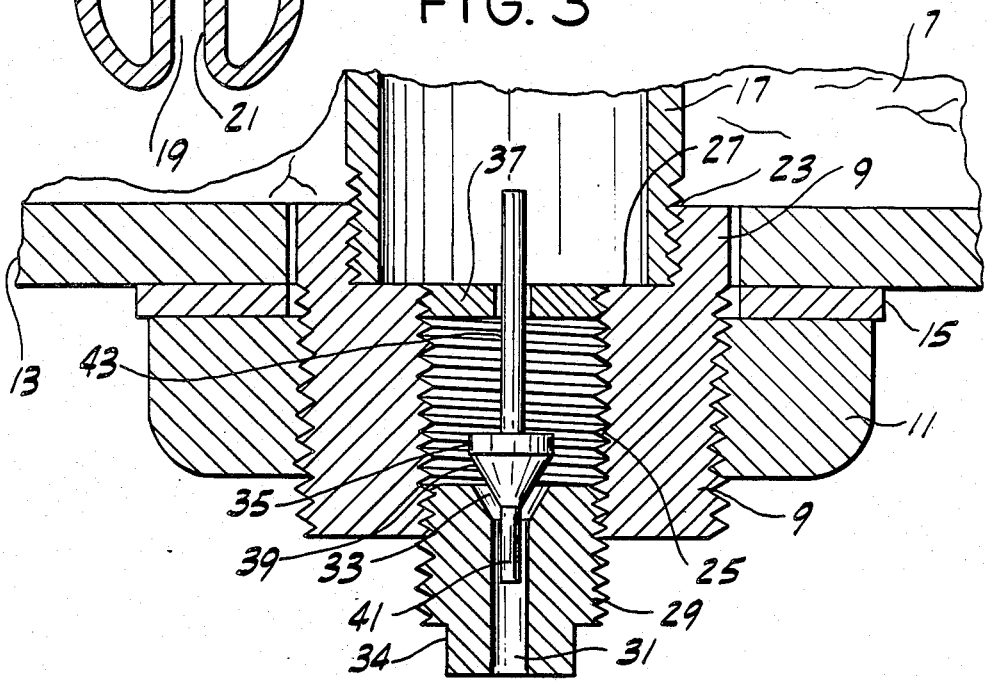
FIG. 3 is an enlarged longitudinal section of the lower end of the bolt on line 3—3 of FIG. 1.

Referring to FIG. 1 of the drawings, there is generally indicated at 1 an expansion bolt of this invention comprising a hollow shank portion 3 shown extending up in a drill hole or bore 5 in the roof 7 of a mine, and a threaded portion constituting a head 9 shown extending down out of the bore and having a nut 11 threaded thereon. As best illustrated in FIG. 3, a roof bolt plate 13 and a washer 15 are carried on the head, the washer 15 bearing on the upper or inner face of the nut, the roof bolt plate 13 bearing on the upper or inner face of the washer. With the hollow shank portion 3 anchored in the bore 5, in a manner described hereinafter, the nut 11 may be turned to bring the roof bolt plate 13 into pressurized engagement with the mine roof 7 for supporting the roof.

Figure 2:
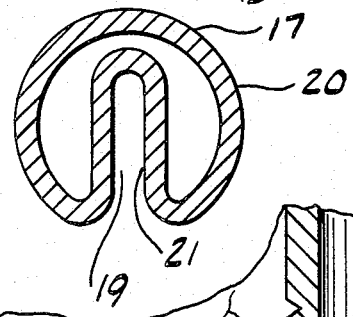
FIG. 2 is a transverse section of the bolt on line 2—2 of FIG. 1.

In particular, the hollow shank portion 3 of the bolt comprises a relatively thin-walled tubular metal member 17, more particularly a a thin-walled tube 17 of suitable deformable material such as a low-carbon steel (e.g., 1016carbon steel) of a suitable thickness (e.g., one-eighth inch), and of a suitable length (e.g., 3–5 feet long). The tube is crimped and welded closed at one end 18 (i.e., its upper or inner end), as shown in FIG. 1, and is threaded at its other (its lower or outer) end, as shown in FIG. 3, the head 9 being threaded onto the lower end of the tube and closing the tube thereby enabling the bolt to hold pressurizing fluid such as water therein. Upon pressurization of the fluid, the tube 17 is adapted to expand girthwise. To facilitate this expansion, the tube 17 which of a suitable outer diameter (e.g., $1\frac{3}{8}$–$1\frac{3}{4}$ inch), in its unexpanded condition, is so formed as to be of fluted cross section with a generally circular overall outline. More particularly, the tube has a recess 19 in its outer periphery extending from the closed upper end 18 of the tube down toward but stopping short of the lower end of the tube. When viewed in transverse section, as shown in FIG. 2, the tube has a first portion 20 in the shape of an arc of a circle and a second generally U-shaped portion or flute 21 bent inwardly to a position within the confines of the circle.

The head 9 is generally cylindrical, having a circular recess 23 in its upper end and a circular passage 25 of smaller diameter than the recess extending down through the head from the recess to the lower end of the head, a shoulder 27 thereby being formed in the head between the recess 23 and the passage 25. The recess 23 and the passage 25 are internally threaded, the recess receiving the lower end margin of the tube 17 in threaded engagement, with the lower end of the tube engaging the shoulder 27, the passage receiving a threaded plug 29 in threaded engagement.

The plug 29 has an axial hole 31 therein opening into a conical recess in the upper surface thereof constituting a valve seat 33. A threaded adapter of a line (not shown) to a source of fluid under pressure (not shown) is adapted to be threaded on the plug for enabling flow of fluid into the tube 17 via the hole 31 in the plug and the passage 25 in the head. The plug further has a projection 34 of generally square section at its lower end enabling the plug to be turned by a wrench or other suitable tool to advance the plug up in the passage 25 in the head. With fluid held in the bolt, the plug 29, on being advanced up in the passage 25, displaces fluid from the passage up into the tube 17, the plug and the passage thus constituting an expansible chamber means for pressurizing the fluid held in the tube.

A valve member 35 is provided in the passage 25 for holding fluid in the bolt and means, such as a disc 37, is secured in the passage for retaining the valve member in the passage. The valve member 35 has a conical central portion 39 engageable with the valve seat 33 in the plug, a lower projection or stem 41 extending down in the hole 31 in the plug, and an upper projection or stem 43 extending up in the hole in the disc 37, the projections or stems holding the valve member in alignment with the valve seat. The valve member 35 functions as a check valve being movable away from the valve seat 33 in the plug 29 for flow of fluid into the tube 17 and moving into engagement with the valve seat 33 to block fluid flow out of the tube. In addition, the valve member 35 is constructed of a suitable elastomeric material such as natural or synthetic rubber or a low yield strength material such as aluminum, and thus also functions as a relief valve for the bolt in being adapted to be extruded out of the hole 31 in the plug when fluid pressure above a pedetermined level is developed in the bolt, such as may occur on shifting of the mine roof and resultant compressive deformation of the tube.

Figure 4:
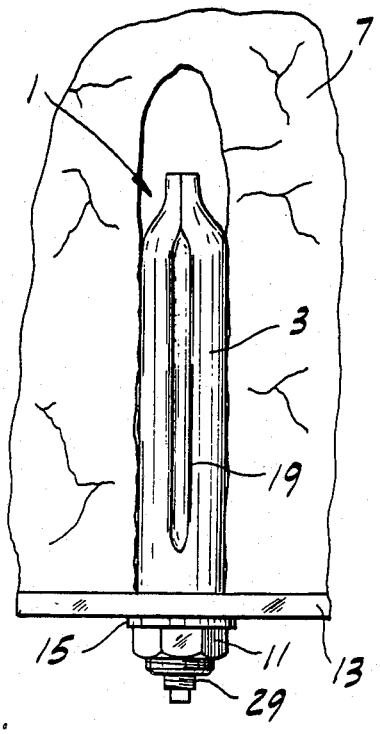
FIG. 4 is a view similar to FIG. 1 showing the bolt expanded girthwise into pressurized engagement with the surfaces of the mine roof defining the bore.

To anchor a bolt 1 of this invention in a bore 5 in the roof 7 of a mine, the bolt, in its unexpanded condition, is inserted into the bore, with the head 9 thereof extending down out of the bore, as shown in FIG. 1. A threaded adapter (not shown) of the line to a source of fluid under pressure (not shown) is threaded on the plug 29, and fluid at a predetermined pressure is introduced into the bolt to expand the tube girthwise into pressurized engagement with the surfaces of the roof defining the bore for anchoring the bolt in the bore as shown in FIG. 4. The roof bolt plate 13 and washer 15 are positioned on the head, and the nut 11 is threaded up on the head to bring the roof bolt plate 13 into pressurized engagement with the roof 7 for supporting it, the load carrying capacity of the bolt for supporting the roof being a function of the magnitude of the static frictional force between the bolt and the surfaces of the mine defining the bore 5 and thus of the pressure of the fluid in the bolt.

Shifting of the mine roof 7 may affect the load carrying capacity of the bolt. Being deformable, the bolt accomodates most shifts of the mine roof and retains its as-installed load carrying capacity. However, to ensure that the bolt is properly anchored, the bolt may be inspected monitored from time to time by measuring the pressure of the fluid. The check valve member 35 is readily opened from outside the head 9 for this purpose. If the fluid pressure is found to be below a predetermined level, the pressure may be increased by reconnecting the line to the source of fluid under pressure (not shown) to the plug 29, or by turning the plug 29 to advance it up in the passage 25. In the event that the shifting of the mine roof causes compressive deformation of the bolt of sufficient magnitude as to increase the fluid pressure above a predetermined relief pressure, the valve member 35 is extruded through the hole 31 in the plug 29 to release the fluid in the bolt.

In certain respects, the expansion bolt of this invention, when anchored, supports the roof in a manner similar to each of the prior art types of anchoring means. Like the "point anchored" mechanical bolt, the bolt of this invention, upon tightening of the nut 11 thereon, effects a clamping of the roof strata. Like the "grouted" bolt system, the bolt of this invention pegs the roof strata together. And like the "friction rock stabilizer" system, the bolt of this invention is effective in relatively soft roof strata, and retains its load carrying capacity on most shifts of the mine roof. However, the bolt of this invention in contrast to the prior art anchoring means has increased load carrying capacity, may be inspected monitored to ensure proper anchorage, and applies a lateral compressive force to the mine roof counteracting, at least in part, the lateral tension force present in the roof due to the tendency of the mine roof to sag.

While the bolt 1 of this invention has been described above and shown in the drawings as being anchored in a bore 5 in the roof of a mine, it is contemplated it could be anchored in a hole in other structures such as the floor or wall of a building. Moreover, while the upper end 18 of the tube 17 is described and shown as being closed by crimping and welding and the head 9 threaded on the lower end of the tube, it is contemplated that the upper end of the tube could be closed by an end cap (not shown) welded or threaded to the upper end of the tube, and the head 9 welded onto the lower end of the tube.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An expansion bolt adapted for insertion in an initial unexpanded condition in a hole drilled in a body in which the bolt is to be anchored, and adapted to be expanded girthwise after being inserted in the hole to anchor it in the hole, said bolt having an elongate hollow shank portion constituted by a relatively thin-walled tubular metal member closed at one end constituting its inner end as inserted in the hole and having a head at its other end constituting its outer end, said head being exteriorly threaded for reception of a nut and extending out of the hole when the bolt is anchored in the hole, said tubular member, in its unexpanded condition, being of fluted cross section, said tubular member being adapted to hold a fluid under pressure and to expand girthwise under pressure of fluid therein, and said head being constructed for delivery of fluid under pressure into said tubular member whereby, following insertion of the tubular member in a hole, fluid under pressure may be delivered into the tubular member to cause it to expand girthwise into pressure engagement with the body within the hole for anchoring it in the hole, the head having a passage for flow of pressurizing fluid into the tubular member, means associated with the head for pressurizing the fluid held in the tubular member comprising expansible chamber means in the head, said expansible chamber means comprising a plug in threaded engagement with the head in the passage, whereby, on turning the plug to advance it in the passage, pressurizing fluid may be displaced from the passage into the tubular member, the plug having a hole extending therethrough, and wherein the expansion bolt further comprises a valve member retained in said passage in the head movable into and out of engagement with the plug to block and unblock the hole in the plub.

2. An expansion bolt as set forth in claim 1 adapted to be received in a bore in the roof of a mine which is subject to shifting with resultant compressive deformation of the bolt increasing the pressure of the fluid held in the bolt, said valve member being of an elastomeric or metallic material and being adapted to be extruded through the hole in the plug under the increased pressure of the fluid to release the fluid in the tubular member.

3. An expansion bolt adapted for insertion in an initial unexpanded condition in a hole drilled in a body in which the bolt is to be anchored, and adapted to be expanded girthwise after being inserted in the hole to anchor it in the hole, said bolt having an elongate hollow shank portion constituted by a relatively thin-walled tubular metal member closed at one end constituting its inner end as inserted in the hole and having a head at its other end constituting its outer end, said head being exteriorly threaded for reception of a nut and extending out of the hole when the bolt is anchored in the hole, said tubular member, in its unexpanded condition, being of fluted cross section, said tubular member being adapted to hold a fluid under pressure and to expand girthwise under pressure of fluid therein, and said head being constructed for delivery of fluid under pressure into said tubular member whereby, following insertion of the tubular member in a hole, fluid under pressure may be delivered into the tubular member to cause it to expand girthwise into pressure engagement with the body within the hole for anchoring it in the hole, the tubular member having an unexpanded cross-sectional shape comprising a first portion generally in the shape of an arc of a circle and second portion bent inwardly to a position within the confines of the circle, said second portion being of U-shape, the head comprising a cylindrical member having an axial passage therethrough from one end constituting its outer end to its other end constituting its inner end, said cylindrical member having a recess at its inner end surrounding the inner end of passage, the outer end of the tubular member being secured in said recess, and means at the outer end of the passage for connection of a line for delivery of fluid under pressure to and through the passage, the passage being threaded and said means at the outer end of said passage comprising a threaded plug threaded in the passage, said plug having an axial hole for passage of fluid, and a valve member for the hole in the plug adapted to open for delivery of fluid through the hole in the plug into the passage in the head and to close to hold fluid in the passage and the tubular member, said plug being adapted to be threaded inwardly in the head, with fluid in the passage and tubular member, to close the valve member and force fluid from the passage into the tubular member.

4. An expansion bolt as set forth in claim 3 adapted to be received in a hole drilled in the roof of a mine which is subject to shifting such as may result in compression of the tubular member and increased pressure of fluid held in the tubular member and passage, said valve member being made of a material which is adapted to extrude through the hole in the plug under said increased pressure of the fluid to release the fluid.

5. An expansion bolt adapted for insertion in an initial unexpanded condition in a hole drilled in a body in which the bolt is to be anchored, and adapted to be expanded girthwise after being inserted in the hole to anchor it in the hole, said bolt having an elongate hollow shank portion constituted by a relatively thin-walled tubular metal member closed at one end constituting its inner end as inserted in the hole and having a head at its other end constituting its outer end, said tubular member, in its unexpanded condition, being of fluted cross section, said tubular member being adapted to hold a fluid under pressure, and to expand girthwise under pressure of fluid therein, said head having a passage therethrough to said tubular member and valve means in said passage in the head adapted to open for delivery of fluid under pressure through said passage into said tubular member for expanding it after the bolt has been inserted in a hole and to close for maintaining fluid under pressure in said expanded tubular member for anchoring it in the hole, wherein the valve means comprises a check valve member arranged to open for delivery of fluid under pressure through said passage into said tubular member and to close following delivery of the fluid to hold the fluid under pressure in said expanded tubular member.

6. An expansion bolt as set forth in claim 5 wherein the check valve member is accessible for being opened from outside the head for monitoring pressure in the expanded tubular member from time to time.

7. An expansion bolt as set forth in claim 6 wherein the passage extends axially of the head from the outside of the head and has an inwardly facing valve seat, and the check valve member is engageable with said seat.

8. An expansion bolt adapted for insertion in an initial unexpanded condition in a hole drilled in a body in which the bolt is to be anchored, and adapted to be expanded girthwise after being inserted in the hole to anchor it in the hole, said bolt having an elongate hollow shank portion constituted by a relatively thin-walled tubular metal member closed at one end constituting its inner end as inserted in the hole and having a head at its other end constituting its outer end, said tubular member, in its unexpanded condition, being of fluted cross section, said tubular member being adapted to hold a fluid under pressure, and to expand girthwise under pressure of fluid therein, said head having a passage therethrough to said tubular member and valve means in said passage in the head adapted to open for delivery of fluid under pressure through said passage into said tubular member for expanding it after the bolt has been inserted in a hole and to close for maintaining fluid under pressure in said expanded tubular member for anchoring it in the hole, wherein the tubular member has an unexpanded cross-sectional shape comprising a first portion generally in the shape of an arc of a circle and a second portion bent inwardly to a position within the confines of the circle, and wherein the valve means comprises a check valve member arranged to open for delivery of fluid under pressure through said passage into said tubular member and to close following delivery of the fluid to hold the fluid under pressure in said expanded tubular member.

9. An expansion bolt as set forth in claim 8 wherein the check valve member is accessible for being opened from outside the head for monitoring pressure in the expanded tubular member from time to time.

10. An expansion bolt as set forth in claim 9 wherein the passage extends axially of the head from the outside of the head and has an inwardly facing valve seat, and the check valve member is engageable with said seat.

11. The method of reinforcing the roof of a mine comprising:

providing an expansion bolt having an elongate hollow shank portion constituted by a relatively thin-walled tubular metal member closed at one end constituting its inner end and having a head at its other end, said tubular member, in its unexpanded condition, being of fluted cross section, said tubular member being adapted to hold a fluid under pressure and to expand girthwise under pressure of fluid therein, said head having valve means therein adapted to open for delivery of fluid under pressure into said tubular member for expanding it and to close for maintaining pressure in said tubular member, providing a hole in the roof of such size as to permit insertion of the shank portion of the bolt therein with the head extending down out of the hole, connecting a source of fluid under pressure to the passage in the head and delivering fluid under pressure through the passage, the valve being open, into the tubular member for expanding it girthwise into pressure engagement with the roof within the hole for anchoring it in the hole, and effecting closing of the valve means to maintain pressure in the expanded tubular member, wherein opening of the valve means is effected by the delivery of fluid under pressure to said passage and closing of the valve means is effected by cutting off the delivery.

* * * * *